United States Patent [19]

Kerkenbush et al.

[11] 4,351,129

[45] Sep. 28, 1982

[54] FLYING DISC WITH CENTRAL INSERT

[75] Inventors: Darle L. Kerkenbush; Jimmie L. Whittington, both of Diamond Bar; Terry J. Sanchez, Pomona, all of Calif.

[73] Assignee: Wham-O Mfg. Company, San Gabriel, Calif.

[21] Appl. No.: 191,073

[22] Filed: Sep. 26, 1980

[51] Int. Cl.[3] ..... A63H 27/00

[52] U.S. Cl. ..... 46/74 D; 264/248

[58] Field of Search ..... 46/74 D; 273/424, 425; 264/248, 249, 263; 156/292, 290; 40/158 B, 158 R, 46, 273

[56] References Cited

U.S. PATENT DOCUMENTS

| | | | |
|---|---|---|---|
| 3,235,991 | 2/1966 | Harper et al. | 40/158 R |
| 3,707,789 | 1/1973 | Hart | 40/587 |
| 4,051,218 | 9/1977 | Hotton | 264/248 X |
| 4,173,839 | 11/1979 | Kovac | 46/74 D |
| 4,176,843 | 12/1979 | De Witt, Jr. | 46/74 D X |
| 4,204,357 | 5/1980 | Harrington | 46/74 D |

*Primary Examiner*—Gene Mancene
*Assistant Examiner*—Mickey Yu
*Attorney, Agent, or Firm*—Christie, Parker & Hale

[57] ABSTRACT

A circular flying disc is provided. The flying disc has an insert permanently secured across a circular aperture through its center by means of a fusion bond between an annular section of the disc and a retaining ring.

59 Claims, 9 Drawing Figures

FLYING DISC WITH CENTRAL INSERT

FIELD OF THE INVENTION

This invention relates to the field of flying disc sport and exercise devices and, more specifically, the structure and process of manufacture of a flying disc with a clear or opaque insert in its center.

BACKGROUND OF THE INVENTION

Flying discs such as are used for sport and exercise have been known for many years, since first marketed by the Wham-O Mfg. Co., under the trademark FRISBEE® disc. More recently, a variety of flying discs have been introduced onto the market.

One recent design having a circular insert in the center of an annular disc is disclosed by DeWitt, U.S. Pat. No. 4,176,843. DeWitt provides for a thin circular insert to be attached to an annular flying disc by means of pins extending from the disc through holes in the insert. The pins are thermally deformed to retain the insert. The problem with DeWitt is that it is suitable only for attaching inserts of relatively undeformable material. This method is unsuitable for attachment of an insert comprising a thin film material such as a polyester sheet since the pegs could deform the sheet and ultimately slip through holes in the periphery of the insert. Alternative methods of bonding a central insert to an annular disc, suggested by DeWitt, include adhesives or thermoplastic bonding. Since the insert in DeWitt is composed of the same thermoplastic material as the annular disc, the two may be readily joined by these methods.

A method of attaching a circular insert of a plastic material such as polyester to an annular flying disc is disclosed in Harrington, U.S. Pat. No. 4,204,357. Harrington shows an annular disc having a plurality of projections molded near its inner perimeter. An insert with a plurality of holes adjacent to its perimeter fits over the disc and associated projections. The projections are heated and flattened out to hold the insert to the disc. Harrington also teaches the application of an adhesive tape over the heads of the projections to further hold the insert in place.

This method suffers several deficiencies for the attachment of a polyester insert. Without some positive means of attachment, the insert will detach from the disc, either by elastic deformation of the flattened projections or by deformation of the holes in the insert. The adhesive tape alone is ineffective to hold the insert to the disc.

Because of the diverse composition of polyester and a thermoplastic such as polyethylene, of which such discs are usually constructed, the polyester cannot be fusion bonded to a thermoplastic disc with any degree of success. The polyester may slowly detach from the annular section of the disc, impairing the disc's aerodynamic integrity, or may separate completely, defeating the purpose of the device and detracting from its aesthetic appeal.

Harrington recognizes this fact and teaches a rather long and complex method of bonding polyester to polyethylene using a flame to specially prepare the surface for a critically defined time period. A special adhesive must be applied to the surfaces to be bonded and allowed to cure before the surfaces are joined. This procedure practically requires that every disc be hand made.

The foregoing gives rise to the need for a practical method and structure for securing an insert of one material to a disc constructed of a different material.

SUMMARY OF THE INVENTION

It is a primary objective of the present invention to provide a flying disc wherein a circular insert is permanently secured across an aperture through the center of the disc. The aperture is preferably circular, but apertures having other shapes can be used if desired. The insert, which is preferably a thin polyester film or other like material, can, in accordance with practice of this invention, be simply, quickly, and economically secured permanently across the aperture.

The circular flying disc of a preferred embodiment of this invention comprises an annular section molded of a thermoplastic material and of one piece construction. The annular section has a circular aperture through its center, a generally concave inner surface, a generally convex outer surface, an inner periphery, and an outer periphery. A rim extends around its outer periphery and a flat circular recess is disposed on one of its surfaces and extends around its inner periphery.

In one preferred embodiment, the flat circular recess is disposed on the inner surface of the annular section while, in another preferred embodiment, the flat circular recess is disposed on the outer surface.

A plurality of spaced apart pegs extend from the recess wherein the pegs are positioned around the inner periphery of the annular section. A circular insert, which has a plurality of holes through its periphery, is across the aperture. The holes in the periphery are positioned so as to register the pegs and the pegs extend through the holes.

A closed strip, also molded of a thermoplastic material, preferably the same thermoplastic material as used for the annular section, is contacted to the pegs. In a preferred embodiment, when the aperture is circular, the closed strip is a circular retaining ring. A thermoplastic bond is formed between the retaining ring and the pegs by heating the top surface of the pegs and a surface of the ring until the surfaces are melted. The molten surfaces are then held firmly together until they cool. The insert is held permanently in place by a fusion bond between the retaining ring and pegs.

The insert is constructed of a material which shrinks upon a first application of heat. Heat is applied to the insert after the cooling of the ring and pegs so as to tighten the insert within the aperture, thereby augmenting the rigidity of the disc.

Subsequently, or at the same time that the insert is heated for tightening, transparent or opaque indicia can be imparted to the insert, if desired, using a type of heat-sensitive transfer paper described below.

Alternatively, if desired, the insert can be decorated before it is secured across the aperture using photographic techniques, silk screening, lithographic printing, or offset printing or the like.

Practice of this invention results in a flying disc with a clear or opaque central insert which is attached to the disc by means of a fusion bond between the retaining ring and pegs, rather than by a bond between the film and other components of the disc. An insert affixed to the disc in this manner is certain to stay attached to the disc barring extraordinary use.

In addition, such a flying disc may have any type of transparent or opaque indicia on the insert such as photographs, transparencies, or writing. Furthermore, the indicia printed on the insert according to this process cannot be worn off since dyes used for forming the indicia permeate the surface of the insert.

BRIEF DESCRIPTION OF THE DRAWINGS

These and other features, aspects, and advantages of the present invention will be more fully understood when considered with respect to the following detailed description, appended claims, and accompanying drawings wherein:

DETAILED DESCRIPTION

Figure 1:
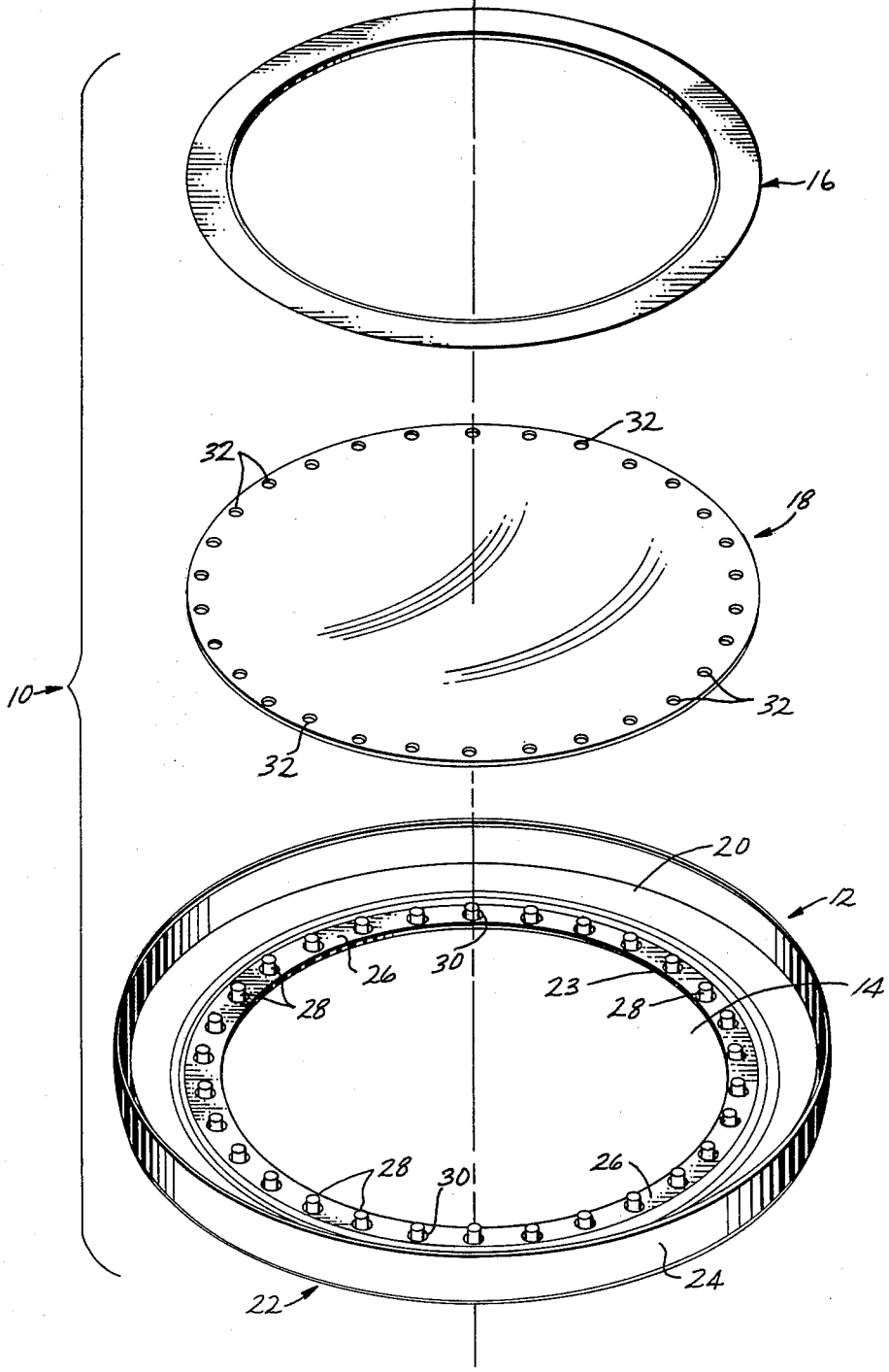
FIG. 1 is an exploded, perspective view of one preferred embodiment of a flying disc provided in accordance with this invention.

Referring to FIG. 1, there is shown an exploded, perspective view of a preferred embodiment of a circular flying disc 10 provided in accordance with this invention.

The flying disc 10 comprises an annular section 12, with an aperture 14 through its center, a closed strip 16, and an insert 18. The insert is permanently secured across the aperture by bonding between the closed strip 16 and the annular section. Preferably, the aperture 14 is circular as shown, although apertures having other shapes can be used if desired. The closed strip 16 is of predetermined geometric shape corresponding to the shape of the aperture. For example, when the aperture is circular, the closed strip 16 is a circular retaining ring.

The annular section 12 can be of one piece construction and is preferably injection molded of a thermoplastic material. Thermoplastic materials which can be used include polyethylene, polypropylene, polystyrene, or the like. The annular section 12 can be of various colors as desired.

As described above, preferably the annular section has a circular aperture 14 through its center and additionally has a generally concave inner surface 20 and a generally convex outer surface 22. The circular aperture 14 defines the inner periphery 23 of the annular section.

Although the circular flying disc can be held in any position, for purposes of exposition herein, the position of the components of the disc relative to each other are described as if the disc is placed flat on a horizontal surface.

The circular aperture 14 can be any size as desired. The size of the aperture, for instance, can depend on the overall size of the disc and the desired size of the insert to be used.

A rim 24, which is an integral part of the annular section, extends around and defines its outer periphery.

A flat circular recess 26 is disposed on the inner or concave surface 20 of the annular section 12. The recess 26 extends around the inner periphery of the annular section and can be of varying widths, as desired.

Figure 2:
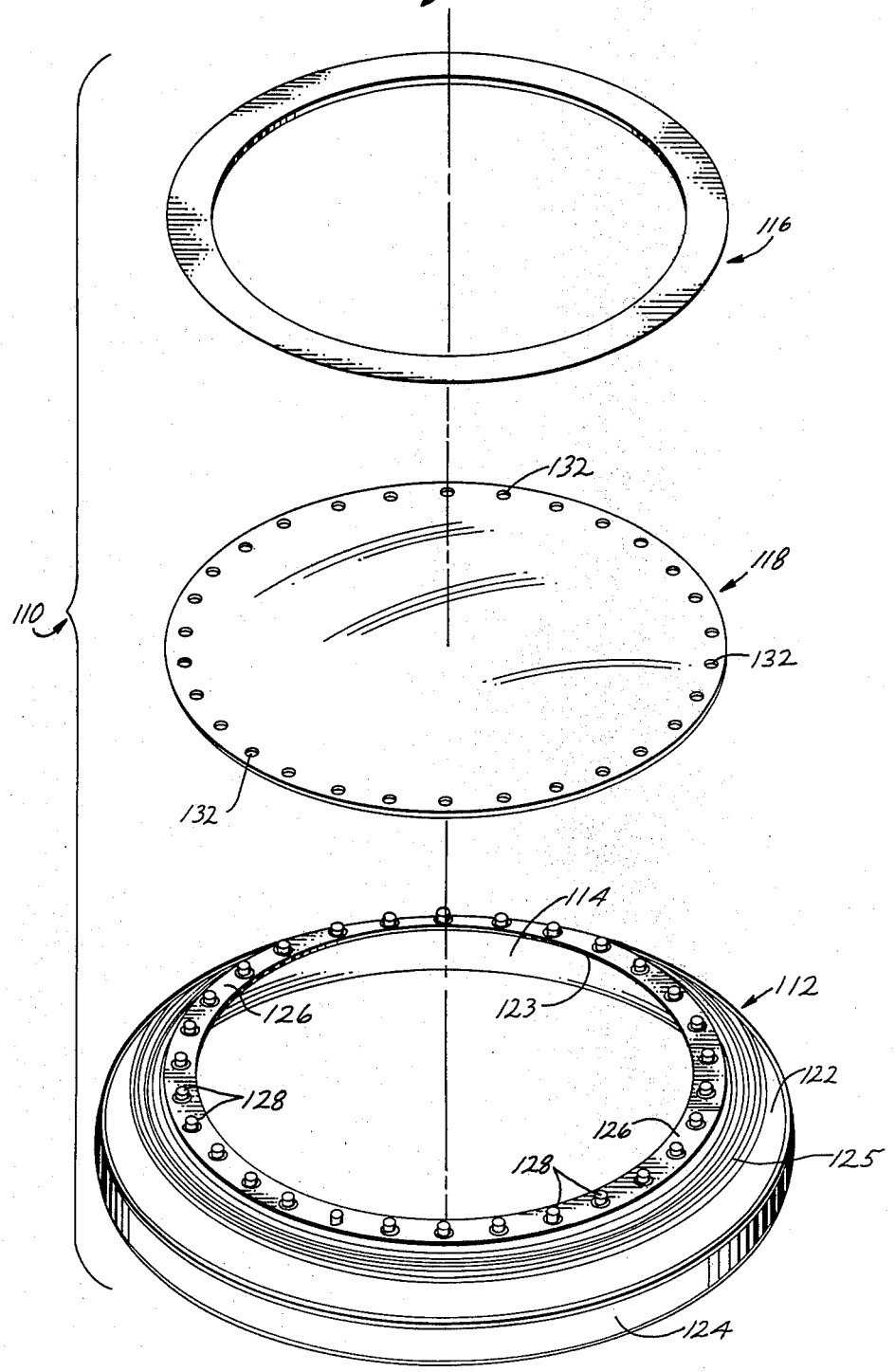
FIG. 2 is an exploded, perspective view of another preferred embodiment of a flying disc provided in accordance with this invention.

Alternatively, in another preferred embodiment, described below in greater detail and shown in FIG. 2, a circular flying disc 110 has a flat circular recess 126 disposed on the outer or convex surface 122 of its annular section 112. The flat circular recess 126 extends around the inner periphery 123 of the annular section 112.

Referring again to FIG. 1, a plurality of spaced apart pegs 28 extend upwardly from the flat circular recess 26. In other words, the pegs are perpendicular to the surface of the recess. The pegs are preferably equally spaced apart and positioned around the inner periphery of the annular section 12. If desired, however, other spacings can be used.

If desired, the flat circular recess can be omitted and the pegs can extend either from the concave or convex surface of the annular section.

Figure 6:
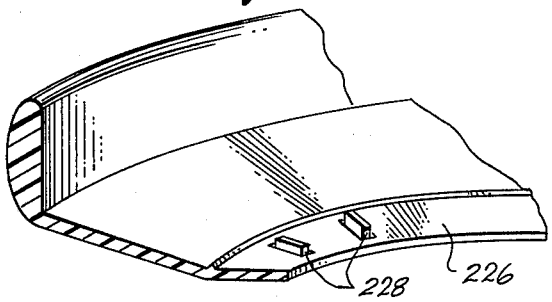
FIGS. 6–8 are cross-sectional views of fragments of different embodiments of flying discs provided in accordance with this invention.
Figure 7:
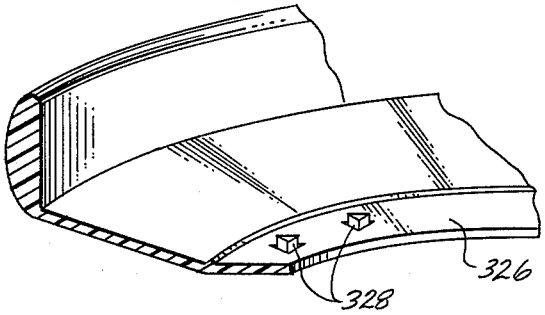
Figure 8:
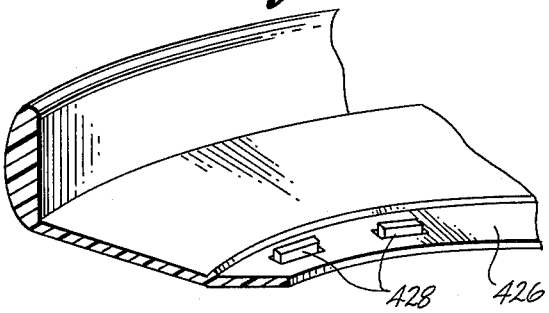

Although the pegs shown in FIG. 1 are cylindrical in shape, pegs having other shapes can alternatively be provided if desired. For example, in an exemplary embodiment shown in FIG. 6, a flat circular recess 226 has a plurality of spaced apart pegs 228 of rectangular shape extending therefrom. Referring to FIGS. 7 and 8, respectively, a flat circular recess 326 has a plurality of triangular shaped pegs 328 extending therefrom and a flat circular recess 426 has a plurality of arcuate shaped pegs 428 extending therefrom. The arcuate shaped pegs 428 have vertical sides which curve with a radius about equal to the radius of the recess. Pegs of other shapes can be also used if desired.

Preferably, the pegs 28 extend from a groove 30 in the surface of the flat circular recess 26. This can best be understood by referring to FIG. 3, as well as FIG. 1. The groove 30 surrounds each peg and, in a preferred embodiment, is formed in the shape of the peg. In other words, the groove 30 is circular when the peg 28 is cylindrical. The top end 28*a*, i.e., the top surface, of each peg extends beyond the surface 26*a* of the flat circular recess to provide a contact for a surface of the retaining ring 16.

The insert 18 provided to cover the circular aperture 14 is also circular and is preferably a polyester film such as Mylar. If desired, however, the insert can be of other suitable materials, such as acrylic material or polycarbonate material or a laminate of polyethylene and polyester or even cloth such as denim. Mylar film is manufactured and distributed by E. I. DuPont de Nemours & Co., Inc., of Wilmington, Del.

It has been found that a polyester film such as Mylar about 0.01 inches in thickness provides a desirable combination of strength, rigidity, and weight to the flying disc so that use of a polyester film of about this thickness is preferred. Films having other thicknesses can also be used, however, if desired.

Preferably, the diameter of the circular insert 18 is about equal to the diameter of the flat circular recess 26. A plurality of holes 32 extend through the insert and are spaced around its periphery. The holes are located in the same spaced relation as the pegs 28 which extend from the flat recess 26. Additionally, the holes are preferably the same shape as the pegs.

When the insert 18 is located with its periphery resting in the recess 26, the holes 32 are aligned, i.e., registered, with the pegs 28, and the pegs extend through the holes. The insert thereby extends across and completely covers the circular aperture 14.

The closed strip, i.e., flat retaining ring 16, is preferably made of the same thermoplastic material as comprises the annular section 12, although if desired the ring and annular section can be of different thermoplastics. The retaining ring can be formed by injection molding or other like process.

If desired, the color of the ring can be of a contrasting color to that of the annular section 12 to distinguish and individualize one flying disc from another.

Figure 3:
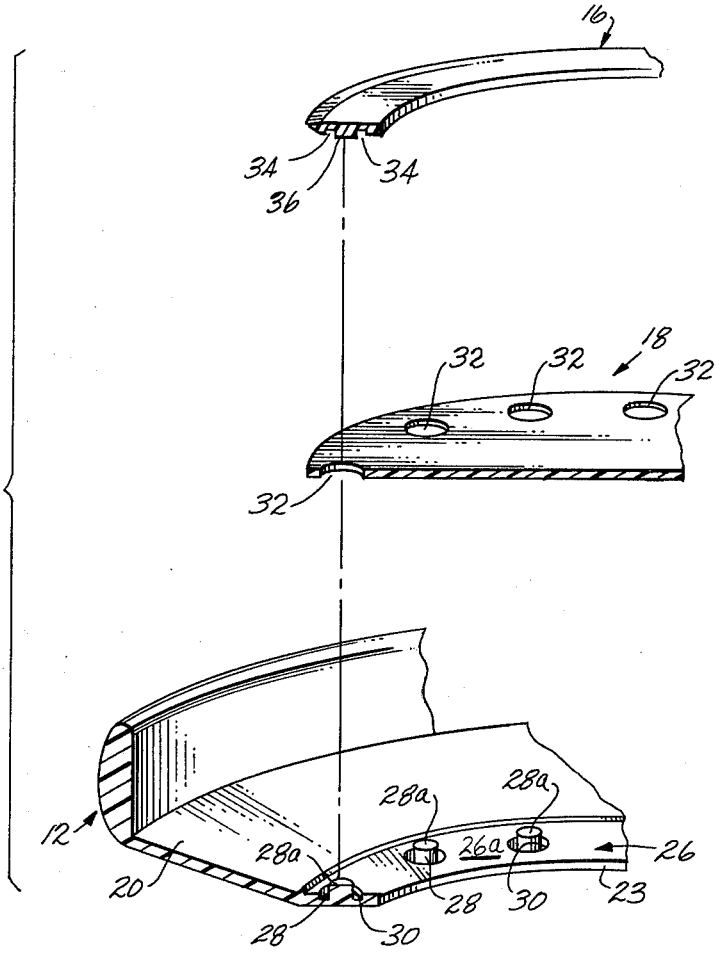
FIG. 3 is a fragmentary, exploded, cross-sectional view in perspective of the flying disc shown in FIG. 1.

The construction of the retaining ring 16 can best be understood by referring to FIG. 3 in addition to FIG. 1. Two adjacent, radially spaced apart grooves 34 extend concentrically around the ring on one of its horizontal surfaces. An extended, flat, raised contact area 36 is defined between the grooves. The contact area 36 protrudes from between the grooves all the way around the ring. Preferably, the outer diameter of the ring is about equal to the outer diameter of the flat circular recess 26 and the inner diameter of the ring is about equal to the inner diameter of the recess. The ring of an exemplary embodiment is about 0.1 inches in thickness although, if desired, rings having other thicknesses can be used.

The retaining ring 16 is disposed with its grooved surface adjacent the periphery of the circular insert 18, the pegs 28, and the flat circular recess 26. In other words, the ring is disposed around the inner periphery of the annular section 12. The flat contact area 36 is in contact with the pegs which extend through the holes in the insert. This forms a sandwich with the periphery of the circular insert 18 located between the flat recess 26 and the contact area 36 of the ring.

Figure 9:
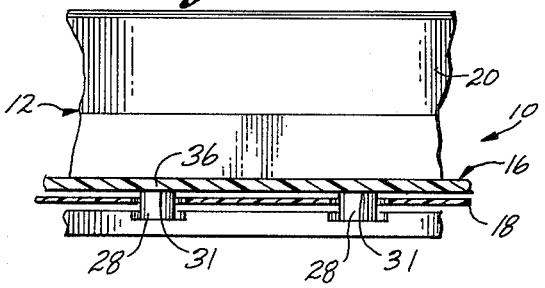
FIG. 9 is a fragmentary cross-sectional side view of the flying disc shown in FIG. 1.

Referring to FIG. 9, a fusion bond 31 is between the contact area 36 of the ring and the pegs 28, thereby holding the ring to the annular section for permanently securing the insert across the aperture 14.

The grooves 30 around each peg act as a reservoir for molten material from the pegs and/or the ring when the surfaces of the pegs and ring are melted for forming the fusion bond 31 therebetween.

Figure 4:
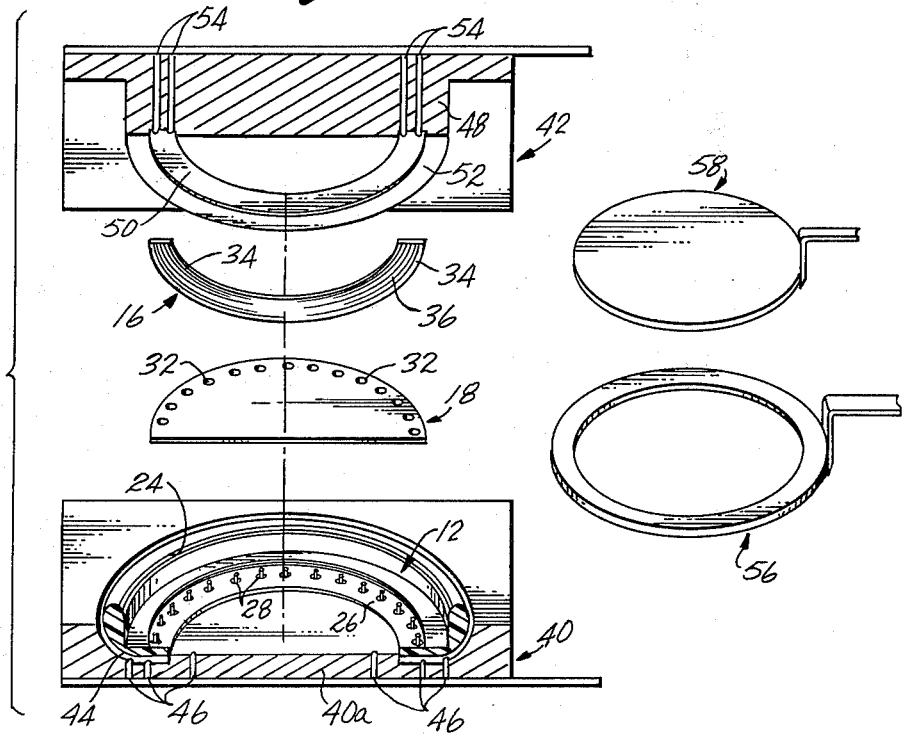
FIG. 4 is a cross-sectional view in perspective of one set of components including fixtures useful for assembly of a flying disc in accordance with this invention.

An examplary method of manufacturing, i.e., assembling, the circular flying disc 10 of the present invention can be understood by referring to FIG. 4. FIG. 4 is an exploded, perspective view of components, including fixtures, used for assembling the disc.

To assemble the disc, two opposed fixtures 40 and 42 are provided. Although the fixtures 40 and 42 are shown one above the other with each fixture oriented horizontally, the fixtures can be oriented at any other angle as desired. Additionally, the fixture 40 can, if desired, be oriented horizontally above the fixture 42 rather than below it.

In this embodiment, a first lower fixture 40 has a circularly shaped recess 44 which is shaped to receive the annular section 12 of the flying disc. The annular section is placed into the recess of the fixture with its rim 24 extending vertically upwardly. The pegs 28 extending from the flat circular recess 26 point vertically upwardly away from the first fixture 40.

A plurality of hollow tubes 46 extend up through the base 40*a* of the lower fixture 40 and terminate in the circular recess 44. The tubes are connected to a vacuum source (not shown) to hold the annular section and insert securely within the fixture during the assembly process.

A second upper fixture 42 has a circularly shaped downwardly extending protrusion 48. The protrusion 48 has dimensions for providing that it can be moved within the rim 24 of the annular section 12 of the disc. The second fixture has a circular recess 50 in its bottom surface 52. The recess 50 is shaped to receive the injection molded thermoplastic retaining ring 16 with its grooved surface facing downwardly toward the bottom fixture 40. A plurality of tubes 54 extend through the fixture and terminate in the circular recess. The tubes 54 are connected to a vacuum source of sufficient strength (not shown) to retain the ring 16 within the recess.

The process of forming the fusion bond 31 between the pegs 28 and the raised contact area 36 of the ring takes place with the annular section 12 and ring 16 disposed in the recesses of the first and second fixtures, and the insert 18 disposed across the aperture 14. When the annular section, ring, and insert are so positioned, the pegs 28 extend through the holes 32 in the insert.

A hot annular platen 56 is provided to heat the ring and pegs. The platen, which is about the same size as the retaining ring, is heated to a sufficient temperature to cause surface melting of the particular thermoplastic used. The hot platen is inserted between the two fixtures and the fixtures are then brought together. The top end, i.e., the top surface, of each of the pegs is contacted to the lower surface of the hot platen while the lower surface, i.e., raised contact area 36, of the retaining ring 16, is contacted to the upper surface of the hot platen. The raised contact area, i.e., the lower surface, of the ring and the top surface of each peg are left in contact with the hot platen for a sufficient time to allow the surfaces to become molten. The temperature of the platen and the time that the pegs and ring remain in contact with the platen can be adjusted, depending on the particular thermoplastic of which the pegs and ring are formed so that proper melting is achieved. The two fixtures are then separated and the platen withdrawn.

Thereafter, the two fixtures are again brought together and the molten top surfaces of the pegs 28 which extend through the holes 32 in the insert are contacted to the molten lower surface, i.e., the raised contact area 36, of the ring 16. The ring and pegs are held together for a sufficient time to allow the thermoplastic to cool and solidify. As the thermoplastic cools, a fusion bond 31 forms between the ring and pegs. The circular insert 18 is thereby securely held permanently in a sandwich between the retaining ring 16 and flat circular recess 26.

Thereafter, the fixtures are again moved apart.

A second hot platen 58 of circular construction is now inserted between the two fixtures and contacted to the secured insert 18. The second platen is dimensioned such that it covers the surface of the insert without contacting the retaining ring. Since the insert is fabricated from a polyester material such as Mylar, a first application of heat causes the insert to contract, thereby augmenting the rigidity of the disc and rendering the insert taut and axially immovable. In the first application of heat to the insert, its temperature is raised to between about 350° F. and 400° F. and maintained at that temperature for approximately 5 to about 45 seconds. Adjustment of the temperature and the time at temperature is made to accommodate inserts of differing thicknesses.

At this time, the circular flying disc 10 can be removed from the first fixture 40 by moving the second hot platen 58 away from the insert. If desired, the vacuum to the fixtures can be discontinued to aid the removal process.

Alternatively, if desired, the assembled flying disc can be retained in the first fixture 40 in order to apply transparent or opaque pictorial or printed indicia to the circular insert, thereby enhancing the disc's appearance.

In an alternative embodiment, the assembled flying disc can be removed from the first fixture 40 and placed in another fixture (not shown) for heating the insert to cause it to contract.

Also, if desired, the indicia can be applied to the insert at the same time that the insert is heated for tightening.

The means for transferring the indicia to the insert comprises using a sheet of flexible transfer paper impregnated with colored dyes. The design or pattern described by the dyes on the paper define the nature of the pictorial or written indicia which are imparted to the insert.

In one embodiment, the transfer paper is laid over the surface of the insert while the disc is still held in the first fixture, and the second circular hot platen 58 is again introduced over the insert and lowered until it contacts the transfer paper and presses it onto the insert. The heat of the second platen is sufficient to cause the dye on the transfer paper to penetrate the surface of the insert. Because the ink penetrates the surface of the insert, the surface can be scratched without allowing the indicia to be scraped or rubbed off.

Finally, the second hot platen is removed along with the used transfer sheet and the finished decorated disc is removed from the fixture.

As described above, in other embodiments the insert can be decorated, i.e., have indicia imparted to its surface before it is secured across the aperture in the annular section of the disc. This can be accomplished by photographic techniques, silk screening, lithographic printing or offset printing, or the like. Also, if desired, the insert can comprise two films of material such as polyester laminated together with the indicia on an inner surface, i.e., the facing surface, of one of the films.

Although the assembly of a circular flying disc has been described with reference to a preferred embodiment shown in FIG. 1, a similar procedure is used for assembly of a second preferred embodiment of the circular flying disc 110 shown in FIG. 2.

The disc 110 comprises an annular section 112 with a circular aperture 114 through its center, a retaining ring 116, and a circular insert 118 of thin film material such as polyester. The circular insert 118 is permanently secured across the aperture 114 by bonding between the retaining ring and the annular section.

Further description of the circular insert 118 and the retaining ring 116 is not needed since they are of the same construction as the insert 18 and ring 16 described for the preferred embodiment shown in FIG. 1.

As described above, and illustrated in FIG. 2, the flat circular recess 126 is disposed on the outer or convex surface 122 of the annular section 112.

Additionally, it is preferable that the annular section 112 further comprise a plurality of concentric circular raised ribs or ridges 125 on its convex outer surface 122. The ribs 125 are concentric about the circular aperture 114.

Although the preferred embodiment shown in FIG. 1 is not described above as having ribs, it is preferred that the annular section 12 comprise a plurality of raised ribs or ridges on its convex outer surface 22, similar to the ribs 125 on the convex surface 122 of the annular section 112.

Details of ribs or ridges formed on the convex surface of a flying disc can be better understood by referring to U.S. Pat. No. 3,359,678 to Headrick. U.S. Pat. No. 3,359,678 is incorporated herein by this reference.

A plurality of spaced apart pegs 128 extend vertically upwardly from the flat circular recess 126 and through holes 132 around the periphery of the insert 118. The flat circular recess 126 and pegs 128 extending upwardly therefrom are similar to the recess 28 and pegs 26 of the first preferred embodiment except that they are on the convex rather than the concave surface of the annular section 112.

Figure 5:
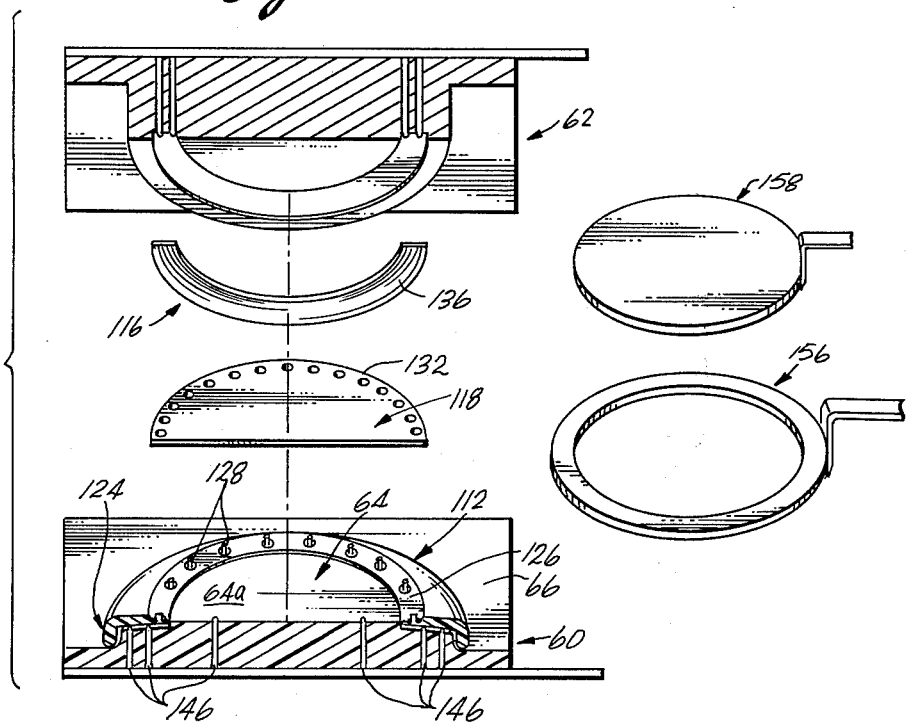
FIG. 5 is a cross-sectional view in perspective of another set of components including fixtures useful for assembly of a flying disc in accordance with this invention.

Referring now to FIG. 5, components which include fixtures used for assembling the flying disc 110 are illustrated.

In this embodiment, two opposed fixtures 60 and 62 are provided or the assembly operation. A first lower fixture 60 has a circular protrusion 64 extending from its upper surface 66. The circular protrusion 64 is shaped so that the rim 124 of the annular section 112 extends over the protrusion and around its periphery. The annular section 112 rests on the upper surface **64*a* of the protrusion. A plurality of hollow tubes 146 extend upwardly through the fixture 60 and terminate at the upper surface 64*a*** of the protrusion. The opposite ends of the tubes are connected to a vacuum source (not shown). The vacuum source and tubes provide a suction to hold the disc and insert to the protrusion during the assembly process.

As was the case for the fixtures 40 and 42, the fixtures 60 and 62 are shown one above the other with each fixture oriented horizontally. If desired, however, the fixtures 60 and 62 can be oriented at any other angle as desired.

The disc is thus disposed on the first fixture with its rim extending vertically downwardly, but with the pegs 128 extending vertically upwardly from the recess 126. The pegs point vertically away from the first fixture 60.

A second upper fixture 62 is also provided which is similar to the first upper fixture 42 described above. Additionally, an annular platen 156 and a circular platen 158 are also provided. The platen 156 and platen 158 are similar to platens 56 and 58 shown in FIG. 4 and described above.

Since the steps used for assembly of the flying disc 110 are similar to the steps above described for assembly of the flying disc 10, they are omitted for simplicity.

After the flying disc 110 is assembled, it is removed from the protrusion 64 of the fixture 60.

The above description of preferred embodiments of circular flying discs and methods for assembling the discs in accordance with this invention is for illustrative purposes. Because of variations which will be apparent to those skilled in the art, the present invention is not intended to be limited to the particular embodiments described hereinabove. The scope of the invention is defined in the following claims.

What is claimed is:

1. A circular flying disc comprising:

an annular section comprising an aperture through its center, an inner periphery and an outer periphery, a generally concave inner surface, a generally convex outer surface, and a rim extending around the outer periphery wherein one of the surfaces of the annular section comprises a plurality of spaced apart pegs positioned around the inner periphery;

an insert disposed across the aperture; and a closed strip fusion bonded to the surface of the annular section comprising the spaced apart pegs, the fusion bond between the closed strip and such a surface of the annular section formed by heating a surface of the closed strip to melt such a strip surface and heating the surface of the annular section to melt such an annular section surface and then contacting the melted surface of the strip with the melted surface of the annular section so that the surfaces solidify together for forming the fusion bond between the closed strip and the pegs, said fusion bond permanently securing the insert in place across the aperture.

2. A circular flying disc according to claim 1 wherein the aperture is circular and the closed strip is a ring.

3. A circular flying disc according to claim 2 wherein the annular section further comprises a plurality of concentric circular raised ribs on its convex outer surface, said ribs being concentric about the circular aperture.

4. A circular flying disc according to claim 2 wherein the annular section further comprises:

a flat circular recess disposed on one surface of the annular section extending around the inner periphery; and the plurality of spaced apart pegs extending from the flat circular recess.

5. A circular flying disc according to claim 4 wherein the annular section further comprises a groove surrounding each peg and located in the flat circular recess, wherein the end of each peg extends beyond the surface of the flat circular recess.

6. A circular flying disc according to claim 4 wherein the insert has a plurality of holes therethrough, the holes spaced around the periphery of the insert and located so as to register the pegs, wherein the pegs extend through the holes.

7. A circular flying disc according to claim 6 wherein the insert is a thin film of plastic material.

8. A circular flying disc according to claim 7 wherein the plastic material is polyester.

9. A circular flying disc according to claim 6 wherein the insert is cloth.

10. A circular flying disc according to claim 6 where two radially spaced apart adjacent grooves extend concentrically around the ring on a surface thereof, wherein an extended, flat, raised contact area is defined between the grooves, said contact area being located so as to abut the spaced apart pegs which extend through the holes in the insert.

11. A circular flying disc according to claim 10 wherein the fusion bond between the ring and the surface of the annular section is between the contact area of the ring and the pegs.

12. A circular flying disc according to claim 6 wherein the flat circular recess and the pegs extending therefrom are disposed on the generally concave inner surface of the annular section.

13. A circular flying disc according to claim 6 wherein the flat circular recess and the pegs extending therefrom are disposed on the generally convex outer surface of the annular section.

14. A circular flying disc according to claim 7 wherein the insert is transparent.

15. A circular flying disc according to claim 7 wherein the insert is opaque.

16. A circular flying disc according to claim 7 wherein transparent indicia are imparted to a surface of the insert.

17. A circular flying disc according to claim 7 wherein opaque indicia are imparted to a surface of the insert.

18. A circular flying disc according to claim 1 wherein the insert comprises two thin films of plastic material laminated together wherein indicia are on a facing surface of one of the films.

19. A circular flying disc comprising:

an annular section comprising a circular aperture through its center, an inner periphery and an outer periphery, a generally concave inner surface, a generally convex outer surface, and a rim extending around the outer periphery, wherein a flat circular recess is disposed on one surface of the annular section extending around the inner periphery and a plurality of spaced apart pegs extend from the flat circular recess, the pegs positioned around the inner periphery;

an insert disposed across the aperture wherein the insert has a plurality of holes therethrough spaced around its periphery, said holes located so as to register the pegs, wherein the pegs extend through the holes;

a ring having two radially spaced apart adjacent grooves extending therearound on its surface, the grooves defining an extended, flat, raised contact area therebetween, the contact area being located so as to abut the spaced apart pegs which extend through the holes in the insert; and a fusion bond between the contact area of the ring and the pegs for permanently securing the insert in place across the aperture.

20. A circular flying disc according to claim 19 wherein the insert is a thin polyester film.

21. A circular flying disc according to claim 19 wherein the flat circular recess and the pegs extending therefrom are disposed on the generally concave inner surface of the annular section.

22. A circular flying disc according to claim 19 wherein the flat circular recess and the pegs extending therefrom are disposed on the generally convex outer surface of the annular section.

23. A circular flying disc according to claim 20 wherein the insert is transparent.

24. A circular flying disc according to claim 20 wherein the insert is opaque.

25. A process for forming a circular flying disc comprising the steps of:

forming an annular section comprising a thermoplastic material, said annular section having:

a generally concave inner surface and a generally convex outer surface;

a circular aperture through its center;

an inner periphery and an outer periphery;

a rim extending around the outer periphery;

a flat circular recess disposed on the inner surface of the annular section extending around the inner periphery; and a plurality of spaced apart pegs extending from the flat circular recess positioned around the inner periphery;

holding the annular section in a first fixture with the rim of the annular section extending vertically for providing that the pegs extending from the flat circular recess point vertically away from the first fixture;

holding a circular retaining ring comprising a thermoplastic material in a second fixture, the second fixture located in opposed relation to the first fixture;

placing a circular insert across the circular aperture of the annular section, said circular insert having a plurality of holes therethrough disposed at predetermined intervals around its periphery, the plurality of spaced apart pegs extending through the holes;

bonding the circular retaining ring to the pegs, thereby permanently securing the insert between the circular retaining ring and the annular section; and thereafter applying heat to the surface of the circular insert to thereby cause the insert to contract for forming the circular flying disc.

26. A process for forming a circular flying disc comprising the steps of:

forming an annular section comprising a thermoplastic material, said annular section having:

a generally concave inner surface and a generally convex outer surface;

an aperture through its center;

an inner periphery and an outer periphery;

a rim extending around the outer periphery;

a flat circular recess disposed on one surface of the annular section, said recess extending around the inner periphery; and a plurality of spaced apart pegs extending from the flat circular recess positioned around the inner periphery;

placing an insert across the aperture of the annular section, said insert having a plurality of holes therethrough disposed at predetermined intervals around its periphery, the spaced apart pegs extending through the holes; and fusion bonding a closed strip comprising a thermoplastic material to the pegs, thereby permanently securing the insert between the closed strip and the annular section for forming the circular flying disc.

27. A process according to claim 26 wherein the aperture and insert are circular and the closed strip is a circular retaining ring comprising a thermoplastic material.

28. A process according to claim 27 wherein the insert is a thin film of plastic material.

29. A process according to claim 28 wherein the plastic material is polyester.

30. A process according to claim 27 comprising fusion bonding the circular retaining ring to the pegs by:

heating a top surface of each of the pegs until such a top surface is molten;

heating a surface of the circular retaining ring until such a surface is molten;

contacting the molten surface of each peg to the molten surface of the ring; and holding the ring and pegs in contact until said ring and pegs cool, thereby allowing a fusion bond to be formed between the pegs and ring.

31. A process according to claim 30 wherein the annular section further comprises a plurality of concentric circular raised ribs on its convex outer surface, said ribs being concentric about the circular aperture.

32. A process for forming a circular flying disc comprising the steps of:

forming an annular section comprising a thermoplastic material, said annular section having:

a generally concave inner surface and a generally convex outer surface;

a circular aperture through its center;

an inner periphery and an outer periphery;

a rim extending around the outer periphery;

a flat circular recess disposed on the inner surface of the annular section extending around the inner periphery; and a plurality of spaced apart pegs extending from the flat circular recess positioned around the inner periphery;

holding the annular section in a first fixture with the rim of the annular section extending vertically for providing that the pegs extending from the flat circular recess point vertically away from the first fixture;

holding a circular retaining ring comprising a thermoplastic material in a second fixture, the second fixture located in opposed relation to the first fixture;

placing a circular insert across the circular aperture of the annular section, said circular insert having a plurality of holes therethrough disposed at predetermined intervals around its periphery, the plurality of spaced apart pegs extending through the holes; and fusion bonding the circular retaining ring to the pegs, thereby permanently securing the insert between the circular retaining ring and the annular section for forming the circular flying disc.

33. A process according to claim 32 wherein the circular insert is cloth.

34. A process according to claim 32 wherein the circular insert is a thin film of plastic material.

35. A process according to claim 34 wherein the plastic material is polyester.

36. A process according to claim 35 comprising fusion bonding the circular retaining ring to the pegs by:

heating a top surface of each of the pegs until each such top surface is molten;

heating a surface of the circular retaining ring until such a surface is molten;

bringing the first and second fixtures together for providing that the molten surface of each peg and the molten surface of the ring come into contact with one another; and holding the first and second fixtures together until the surfaces of the pegs and the ring cool, thereby allowing a fusion bond to be formed therebetween.

37. A process according to claim 36 comprising heating the top surface of each of the pegs and the surface of the ring by:

inserting a hot circular platen between the first and second fixtures;

bringing the first and second fixtures together such that the top surface of each of the pegs and the surface of the ring contact the heated surfaces of the platen for a sufficient time to melt the top surface of each of the pegs and the surface of the ring;

moving the first and second fixtures apart; and removing the heated platen.

38. A process for forming a circular flying disc comprising the steps of:

forming an annular section comprising a thermoplastic material, said annular section having;
a generally concave inner surface and a generally convex outer surface;
a circular aperture through its center;
an inner periphery and an outer periphery;
a rim extending around the outer periphery;
a flat circular recess disposed on the outer surface of the annular section extending around the inner periphery; and
a plurality of spaced apart pegs extending from the flat circular recess positioned around the inner periphery;
holding the annular section in a first fixture with the rim of the annular section extending vertically for providing that the pegs extending from the flat circular recess point vertically away from the first fixture;
holding a circular retaining ring comprising a thermoplastic material in a second fixture, the second fixture located in opposed relation to the first fixture;
placing a circular insert across the circular aperture of the annular section, said circular insert having a plurality of holes therethrough disposed at predetermined intervals around its periphery, the plurality of spaced apart pegs extending through the holes; and
fusion bonding the circular retaining ring to the pegs, thereby permanently securing the insert between the circular retaining ring and the annular section for forming the circular flying disc.

39. A process according to claim 38 wherein the circular insert is cloth.

40. A process according to claim 38 wherein the circular insert is a thin film of plastic material.

41. A process according to claim 40 wherein the plastic material is polyester.

42. A process according to claim 41 comprising fusion bonding the circular retaining ring to the pegs by:
heating a top surface of each of the pegs until such a top surface is molten;
heating a surface of the circular retaining ring until such a surface is molten;
bringing the first and second fixtures together for providing that the molten surface of each peg and the molten surface of the ring come into contact with one another; and
holding the first and second fixtures together until the surfaces of the pegs and the ring cool, thereby allowing a fusion bond to be formed therebetween.

43. A process according to claim 42 comprising heating the top surface of each of the pegs and the surface of the ring by:
inserting a hot circular platen between the first and second fixtures;
bringing the first and second fixtures together such that the top surface of each of the pegs and the surface of the ring contact the heated surfaces of the platen for a sufficient time to melt the top surface of each of the pegs and the surface of the ring;
moving the first and second fixtures apart; and
removing the heated platen.

44. A process according to claim 37 or 43 further comprising applying heat to the surface of the circular insert after said insert is secured between the circular retaining ring and the annular section, thereby causing the insert to contract.

45. A process according to claim 44 further comprising the step of applying transparent indicia to the surface of the circular insert.

46. A process according to claim 44 further comprising the step of applying opaque indicia to the surface of the circular insert.

47. A process according to claim 45 comprising applying the indicia to the surface of the circular insert by the steps of:
positioning a dye impregnated transfer paper adjacent the insert; and
heating the paper, thereby causing the dye to be absorbed into the surface of the insert.

48. A process according to claim 46 comprising applying the indicia to the surface of the circular insert by the steps of:
positioning a dye impregnated transfer paper adjacent the insert; and
heating the paper, thereby causing the dye to be absorbed into the surface of the insert.

49. A process for forming a circular flying disc comprising the steps of:
forming an annular section comprising a thermoplastic material, said annular section having:
a generally concave inner surface and a generally convex outer surface;
a circular aperture through its center;
an inner periphery and an outer periphery;
a rim extending around the outer periphery;
a flat circular recess disposed on the inner surface of the annular section extending around the inner periphery; and
a plurality of spaced apart pegs extending from the flat circular recess positioned around the inner periphery;
holding the annular section in a first fixture with the rim of the annular section extending vertically for providing that the pegs extending from the flat circular channel point vertically away from the first fixture;
holding a circular retaining ring comprising a thermoplastic material in a second fixture, the second fixture located in opposed relation to the first fixture;
placing a circular insert across the circular aperture of the annular section, said circular insert having a plurality of holes therethrough disposed at predetermined intervals around its periphery, the plurality of spaced apart pegs extending through the holes;
bonding the circular retaining ring to the pegs, thereby permanently securing the insert between the circular retaining ring and the annular section; and thereafter
applying heat to a surface of the insert, thereby causing the insert to contract for forming a circular flying disc.

50. A process according to claim 49 wherein the circular insert is a thin polyester film.

51. A process according to claim 50 comprising bonding the circular retaining ring to the pegs by:
heating a top surface of each of the pegs until such a top surface is molten;
heating a surface of the circular retaining ring until such a surface is molten;
bringing the first and second fixtures together such that the molten surfaces of the pegs and ring come into contact with one another; and holding the first and second fixtures together until the surfaces of the pegs and the ring cool, thereby allowing a fusion bond to be formed therebetween.

52. A process according to claim 51 comprising heating the top surface of each of the pegs and the surface of the ring by:

inserting a hot circular platen between the first and second fixtures;

bringing the first and second fixtures together such that the top surface of each of the pegs and the surface of the ring contact the heated surfaces of the platen;

moving the first and second fixtures apart; and removing the heated platen.

53. A process according to claim 52 further comprising applying indicia to a surface of the insert.

54. A process according to claim 53 wherein applying the indicia to the surface of the insert comprises:

positioning a dye impregnated transfer paper adjacent the insert after the insert has been permanently secured between the circular retaining ring and the annular section; and heating the paper, thereby causing the dye to be absorbed into the surface of the insert.

55. A process for forming a circular flying disc comprising the steps of:

forming an annular section comprising a thermoplastic material, said annular section having:

a generally concave inner surface and a generally convex outer surface;

a circular aperture through its center;

an inner periphery and an outer periphery;

a rim extending around the outer periphery;

a flat circular recess disposed on the outer surface of the annular section extending around the inner periphery; and a plurality of spaced apart pegs extending from the flat circular recess positioned around the inner periphery;

holding the annular section in a first fixture with the rim of the annular section extending vertically for providing that the pegs extending from the flat circular channel point vertically away from the first fixture;

holding a circular retaining ring comprising a thermoplastic material in a second fixture, the second fixture located in opposed relation to the first fixture;

placing a circular insert across the circular aperture of the annular section, said circular insert having a plurality of holes therethrough disposed at predetermined intervals around its periphery, the plurality of spaced apart pegs extending through the holes;

bonding the circular retaining ring to the pegs, thereby permanently securing the insert between the circular retaining ring and the annular section; and thereafter applying heat to a surface of the insert, thereby causing the insert to contract for forming a circular flying disc.

56. A process according to claim 55 wherein the circular insert is a thin polyester film.

57. A process according to claim 56 comprising bonding the circular retaining ring to the pegs by:

heating a top surface of each of the pegs until such a top surface is molten;

heating a surface of the circular retaining ring until such a surface is molten;

bringing the first and second fixtures together such that the molten surfaces of the pegs and ring come into contact with one another; and holding the first and second fixtures together until the surface of the pegs and the ring cool, thereby allowing a fusion bond to be formed therebetween.

58. A process according to claim 57 comprising heating the pegs and the ring by:

inserting a hot circular platen between the first and second fixtures;

bringing the first and second fixtures together such that the top surface of each of the pegs and the surface of the ring contact the heated surfaces of the platen;

moving the first and second fixtures apart; and removing the heated platen.

59. A process according to claim 58 further comprising applying indicia to a surface of the insert.

* * * * *